US011684165B2

(12) United States Patent
Daser

(10) Patent No.: US 11,684,165 B2
(45) Date of Patent: Jun. 27, 2023

(54) MOVING BED

(71) Applicant: DATHERA CONSUMER HEALTH GMBH

(72) Inventor: Klaus Daser, Munich (DE)

(73) Assignee: DaThera Consumer Health GmbH, Munich (DE)

( * ) Notice: Subject to any disclaimer, the term of this patent is extended or adjusted under 35 U.S.C. 154(b) by 322 days.

(21) Appl. No.: 16/287,253

(22) Filed: Feb. 27, 2019

(65) Prior Publication Data

US 2020/0196769 A1 Jun. 25, 2020

(30) Foreign Application Priority Data

Dec. 20, 2018 (DE) ..... 10 2018 009 934.3

(51) Int. Cl.
*A47C 21/00* (2006.01)
*A47C 19/02* (2006.01)
*A47C 19/04* (2006.01)

(52) U.S. Cl.
CPC ..... *A47C 21/006* (2013.01); *A47C 19/027* (2013.01); *A47C 19/04* (2013.01)

(58) Field of Classification Search
CPC ..... A47C 21/006; A47C 19/027; A47C 19/04; A47C 23/061; A61H 2201/1669; A61H 2201/123; A61H 2201/1215; A61H 2203/0443; A61H 1/0292; A61H 2001/0233; A61H 1/0222; A61H 2201/0142
(Continued)

(56) References Cited

U.S. PATENT DOCUMENTS 823,152 A * 6/1906 Babcock ..... A47C 19/04 5/183
933,810 A * 9/1909 Wokurka ..... A47C 19/04 5/296

(Continued)

FOREIGN PATENT DOCUMENTS

DE 10246760 A1 * 4/2004 ..... A61H 1/0222
KR 20160100120 A * 8/2016 ..... A61H 1/0222

(Continued)

OTHER PUBLICATIONS

Wikipedia, Newton (unit), Jul. 19, 2017, p. 2 (Year: 2017).*

*Primary Examiner* — David R Hare
*Assistant Examiner* — Luke Hall
(74) *Attorney, Agent, or Firm* — Laurence A. Greenberg; Werner H. Sterner; Ralph E. Locher

(57) ABSTRACT

A moving bed has a fixed bed part as a resting area for the head and upper body of a person, and a longitudinally moving bed part as a resting area for the buttocks and legs of a person. The bed has a first bed frame in the form of a stationary fixed frame that extends as a stationary longitudinal frame over the entire length of the bed and on which the upper, fixed bed part is formed. The bed has a second bed frame as a moving frame, which forms the lower longitudinally moving bed part; the moving frame is held to the fixed frame so that it can move longitudinally. A motor drive is mounted between the fixed frame and the moving frame, and by this motor drive, the moving frame may be moved alternatingly back and forth relative to the fixed frame in a predetermined longitudinal section.

17 Claims, 3 Drawing Sheets

(58) Field of Classification Search
USPC ..... 5/616
See application file for complete search history.

(56) References Cited

U.S. PATENT DOCUMENTS 1,394,331 A * 10/1921 Monroe ..... A47C 19/04 5/183
1,410,476 A * 3/1922 Keane ..... A61G 7/0573 5/105
2,175,614 A * 10/1939 Redfield ..... A61H 15/0078 601/116
2,311,542 A * 2/1943 Edward ..... A61G 7/002 601/87
2,570,676 A * 10/1951 Henderson ..... A47C 21/006 5/109
2,668,530 A * 2/1954 Tackaberry ..... A47C 21/006 601/60
2,690,175 A 9/1954 Daughtry
2,992,044 A * 7/1961 Johnson ..... G07F 17/00 5/503.1
2,999,496 A 9/1961 Parson
3,687,133 A * 8/1972 Grubelic ..... A61H 15/0078 601/102
4,038,710 A * 8/1977 Tambascio ..... A47C 19/04 5/310
4,192,296 A * 3/1980 St. Mary ..... A61H 1/00 601/102
4,277,857 A * 7/1981 Svehaug ..... A47C 21/006 5/108
4,761,000 A * 8/1988 Fisher ..... A61G 13/02 5/601
5,186,424 A * 2/1993 Shultz ..... A47C 21/006 248/179.1
5,320,640 A 6/1994 Riddle et al.
5,574,339 A * 11/1996 Kattwinkel ..... A47D 9/02 297/260.1
5,579,550 A * 12/1996 Bathrick ..... A47C 19/005 5/618
5,613,252 A * 3/1997 Yu ..... A61G 7/001 5/617
5,673,445 A * 10/1997 Suter ..... A47C 21/006 5/104
5,771,510 A * 6/1998 Sun ..... A47C 29/003 5/163
5,940,911 A * 8/1999 Wang ..... A47C 19/045 5/147
6,723,059 B1 * 4/2004 Park ..... A61H 23/0263 5/915
2003/0032902 A1 * 2/2003 Park ..... A47C 21/006 601/84
2005/0039258 A1 * 2/2005 Gavela Vazquez .. A47C 19/025 5/236.1
2007/0143923 A1 * 6/2007 Guo ..... A47C 21/006 5/608
2007/0143924 A1 * 6/2007 Guo ..... A47C 21/006 5/608
2009/0183311 A1 * 7/2009 Nguyen ..... A47C 19/021 5/174
2010/0122415 A1 * 5/2010 Turner ..... A61G 7/018 5/618
2011/0239366 A1 * 10/2011 Boyle ..... A47C 19/024 108/42
2011/0247141 A1 * 10/2011 Poulos ..... A61G 7/16 5/658
2012/0233781 A1 * 9/2012 Farre ..... A61G 7/002 5/616
2012/0240335 A1 * 9/2012 Sauter ..... A47C 23/061 5/400
2013/0269105 A1 * 10/2013 Schulte ..... A47C 19/025 5/400
2015/0305510 A1 * 10/2015 Tarplee ..... A47C 20/041 601/57
2015/0328070 A1 * 11/2015 Tarplee ..... A47C 21/006 5/616
2017/0209320 A1 * 7/2017 Lo ..... A61G 7/015
2017/0312155 A1 * 11/2017 Copetti ..... A47C 20/08
2017/0319410 A1 * 11/2017 Lee ..... A47C 21/00
2017/0354265 A1 * 12/2017 Kramer ..... A61H 23/00
2018/0132626 A1 * 5/2018 He ..... A47C 20/041

FOREIGN PATENT DOCUMENTS

KR 20160100120 A 8/2016
KR 20180106388 A * 10/2018 ..... A61H 1/0222
KR 20180106388 A 10/2018

* cited by examiner 9
10b
11b
12d
12b
12c
11a
10a
12a 12a
16
15
13
14

2
4
6b
8c
8d
7
8b
6a
8a
5b
3
5a

MOVING BED

BACKGROUND OF THE INVENTION

Field of the Invention

The application relates to a moving bed according to the preamble of the independent claim.

A bed of this kind that is known in the art (DE 102 46 760 B4) has a fixed bed part for a person's head and upper body and a longitudinally-moving bed part for a person's buttocks and legs.

Specifically, by means of relative motor movements between the fixed bed part and the longitudinally moving bed part over a mattress with an expansion joint, which is arranged between the fixed and longitudinally moving bed part, sinusoidal movements and loads are exerted on a person's musculature during rest phases. This positively influences the muscles and indirectly the intervertebral discs, and serves in particular to alleviate or prevent chronic complaints and pain.

The fixed bed part and longitudinally moving bed part are depicted in that document as individual separate bed components, and it is indicated that they may be inserted and installed in existing bed frames. It is not shown how such an installation might be accomplished so as to provide the above functions. It is obvious, however, that in arranging and fastening such bed components into existing bed frames, a person of ordinary skill in the art will encounter several unsolved problems in supporting and arranging a drive motor with the action and reaction forces that may arise. In particular, in the case of ordinary wooden bed frames, the alternating tension/compression movements lead to noises in the wood that disturb sleep and also impose unfavorable loads on wood screw connections, which over time may lead to the wood screws coming unscrewed, thus undoing the entire assembly. Another unsolved problem here is arranging and installing rollers in an existing bed frame to support the longitudinally moving bed part, because these rollers would likely have to be attached to the side parts of the bed, and such parts, particularly in the case of wooden bed frames, are not typically configured to absorb and support the forces that would arise.

BRIEF SUMMARY OF THE INVENTION

The objective of the invention is therefore to propose a refinement of the known generic bed according to the preamble of the independent claim, and thus to provide a moving bed that is complete, functional and easy to operate.

This objective is accomplished in that the moving bed has a first bed frame as a stationary fixed frame, which extends as a stationary longitudinal frame over the length of the entire bed and on which the fixed bed part is formed. The moving bed also has a second bed frame as a moving frame, with which the lower longitudinally moving bed part is formed, in such a way that the moving frame is held longitudinally movable on the fixed frame. At least one controllable motor drive is arranged coupled between the fixed frame and the moving frame, and by means of this motor drive, the moving frame may be moved alternatingly back and forth relative to the fixed frame in a predetermined longitudinal section.

With these features, a moving bed is made available that is manageable overall, and in particular is a manageable retail unit in which all necessary components either make up the longitudinal fixed frame or are attached to it, so that all action and reaction forces are supported in the fixed frame together with necessary brackets and fastenings. Both the fixed frame and the moving frame are advantageously manufactured from metallic profiles, so that the product may be easily and cost-effectively manufactured. Time-consuming processes for installation in existing bed frames may be dispensed with, because for example the fixed frame may be placed on existing supports in typical bed frames, similarly to a slatted frame known in the art. And because the moving bed according to the invention may be functional even if it is not installed in a bed frame, the fixed frame may be placed directly on the floor or supported by blocks; in this way, a bed without any bed frame is also made available.

In an advantageous refinement, it is proposed to arrange on the fixed frame, preferably in a lower footing area of the fixed frame, a motor drive consisting of an electric motor and a longitudinally aligned push-pull rod that the motor may actuate, and to couple the push-pull rod to the moving frame. This simple arrangement allows the fixed frame to support the movement forces in a safe and problem-free fashion.

In a particularly simple and cost-effective specific embodiment, the motor drive may be an electromotive eccentric drive with a connecting rod that is coupled to the moving frame, thus enabling beneficial sinusoidal and jerk-free movements. Alternatively, an electric motor with a spindle may also advantageously be used in this case, the spindle nut being attached to the moving frame.

To vary and adjust the movements that may be applied to a person, either the longitudinal section for the moving frame movements, or the movement amplitude, may be adjusted by adjusting the longitudinal position of the motor drive and/or the length of the movement-transmitting rod. The spindle stroke and/or speed of a spindle drive may be controlled electronically with particular ease. In addition, a control device may be used to specify a particular motor running time and/or to set a frequency of a sinusoidal motion sequence in the motor drive.

To obtain a preferably continuous flat resting surface between the fixed bed part and the moving frame, it is proposed that the fixed bed part is formed on the fixed frame in such a way that cross struts, preferably two spaced-apart cross struts that determine the length of the fixed bed part, are mounted on a rectangular base frame of the fixed frame, and that these cross struts have a height like that of the moving frame mounted on the fixed frame.

So that the moving frame may move relative to the fixed frame, a roller guide is proposed. To this end, rollers that are offset from one another, preferably four rollers two of which are respectively opposite each other, are attached to opposite longitudinal parts of the frame in the area of the moving frame, on a rectangular base frame of the fixed frame manufactured from metallic profiles. The rollers are fastened with their axes running transversely, and project upward from the roller longitudinal parts. The rectangular moving frame, which is also made of extruded metallic profiles, is mounted on the protruding rollers with the longitudinal parts of the moving frame. In this way, a structure is made available that is easy to manufacture and operates smoothly, and also provides good support for the loads imposed on the rollers.

In a refinement of this advantageous structure, the rollers are positioned toward the inside of the base frame and, in addition, tracking parts are arranged on the moving frame in which the rollers run, so as to ensure that the moving frame remains on track laterally. U-profiles fixed to the longitudinal parts of the moving frame may readily be used for the tracking parts, to keep the moving frame on track. In addition, retaining parts, preferably z-profiles, may be arranged on the moving frame so as to prevent the moving frame from being lifted off from the fixed frame.

To supplement the above bed structure, a flat rigid or flexible support, preferably a conventional slatted frame, is placed on the fixed bed part of the fixed frame and on the moving frame, the supports being spaced apart in the longitudinal direction at least to the extent of the longitudinal section, for the purpose of supporting the movement of the moving frame.

In addition, a mattress divided at the transition between the fixed bed part and the moving frame, or a mattress continuous in that area and has a compressible and extensible area, is rested on the supports, preferably on the slatted frames.

The motor-driven movements and forces of the moving frame are transferred to a recumbent person via supports or slatted frames and mattresses situated as above. The motor power required for this purpose obviously depends on the kinematics of the arrangement and the weights of the components and the weight of the person currently lying down. All contingencies may be covered if the motor drive is designed in such a way that at least a force of approximately 50 kiloponds may be applied to move the moving frame as quietly as possible.

The invention is additionally explained with reference to an exemplary embodiment.

BRIEF DESCRIPTION OF THE SEVERAL VIEWS OF THE DRAWING

The drawings show the following, in perspective view.

DESCRIPTION OF THE INVENTION

Figures 1, 2, 3:
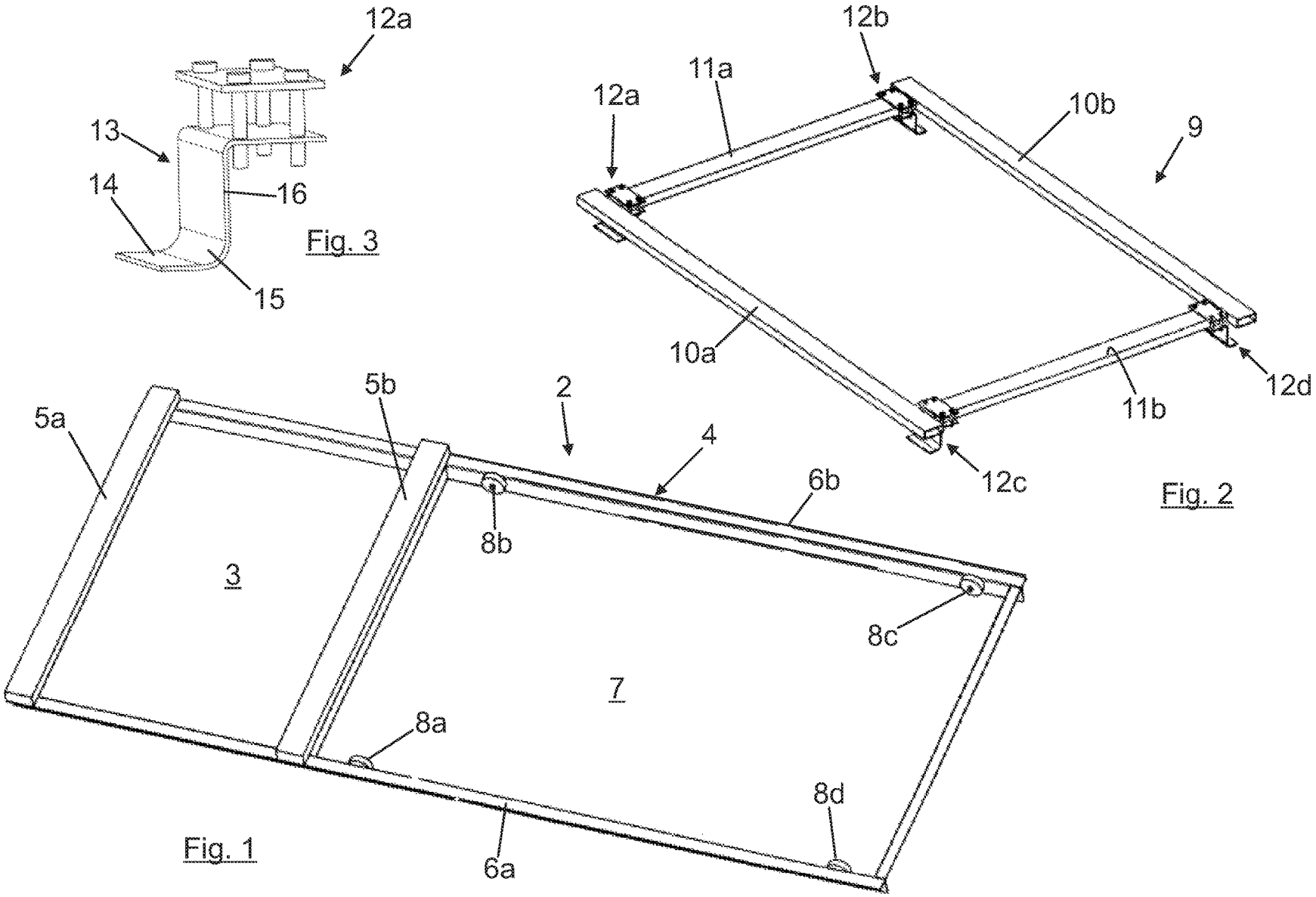
FIG. 1 A fixed frame.
FIG. 2 A moving frame.
FIG. 3 A retaining part in the form of a Z-profile, attached to the moving frame to prevent the moving frame from being lifted upward from the fixed frame.

FIG. 1 shows a fixed frame 2 of a moving bed 1 according to the invention, manufactured from rectangular metallic angle profiles. To form an upper fixed bed part 3, 2 cross struts 5*a*, 5*b* are attached to the base frame 4 of the fixed frame, of which one cross strut 5*a* forms the upper end of the fixed frame 2 and at a distance therefrom, the second cross strut 5*b* defines the length of the fixed bed part 3. The cross struts 5*a*, 5*b* rest on longitudinal frame parts 6*a*, 6*b*.

The upper bed part 3 has a length of about 30 to 40% of the total frame length, corresponding to about the ratio of the length of the upper body of a person 29 to the person's height.

Four rollers 8*a*, 8*b*, 8*c*, 8*d* with roller axes running transversely are arranged in respectively opposite corner areas on the longitudinal frame parts 6*a*, 6*b* in a lower frame area 7; taking into account the roller circumference, these protrude slightly beyond the longitudinal moving frame parts 6*a*, 6*b*.

FIG. 2 shows a rectangular moving frame 9 manufactured from metallic extruded profiles, having a length slightly less than that of the lower frame area 7. The moving frame 9 is mounted on the rollers 8*a*, 8*b*, 8*c*, 8*d* with moving frame longitudinal parts 10*a*, 10*b*, in such a way that it may be moved longitudinally. In the corner areas of the moving frame 9, retaining parts 12*a*, 12*b*, 12*c*, 12*d* in the form of Z-shaped profiles are clamped to the moving frame cross struts 11*a*, 11*b*.

FIG. 3 shows an enlarged view of such a z-shaped retaining part 12*a*; the retaining part consists of a z-shaped angle part 13, which with an approximately horizontal angle leg 14 engages under the associated roller 8*a* and merges into a vertical angle leg 16 by means of an inclined ramp 15. The four z-shaped retaining profiles 12*a* to 12*d* secure the mounted moving frame 9 against being lifted off from the fixed frame 2. The longitudinal movement is kept on track by two U-profiles (not shown) that are approximately 13 cm long; these profiles grip around two of the four rollers and are fastened to the moving frame, on either the left or right side.

Figure 4:
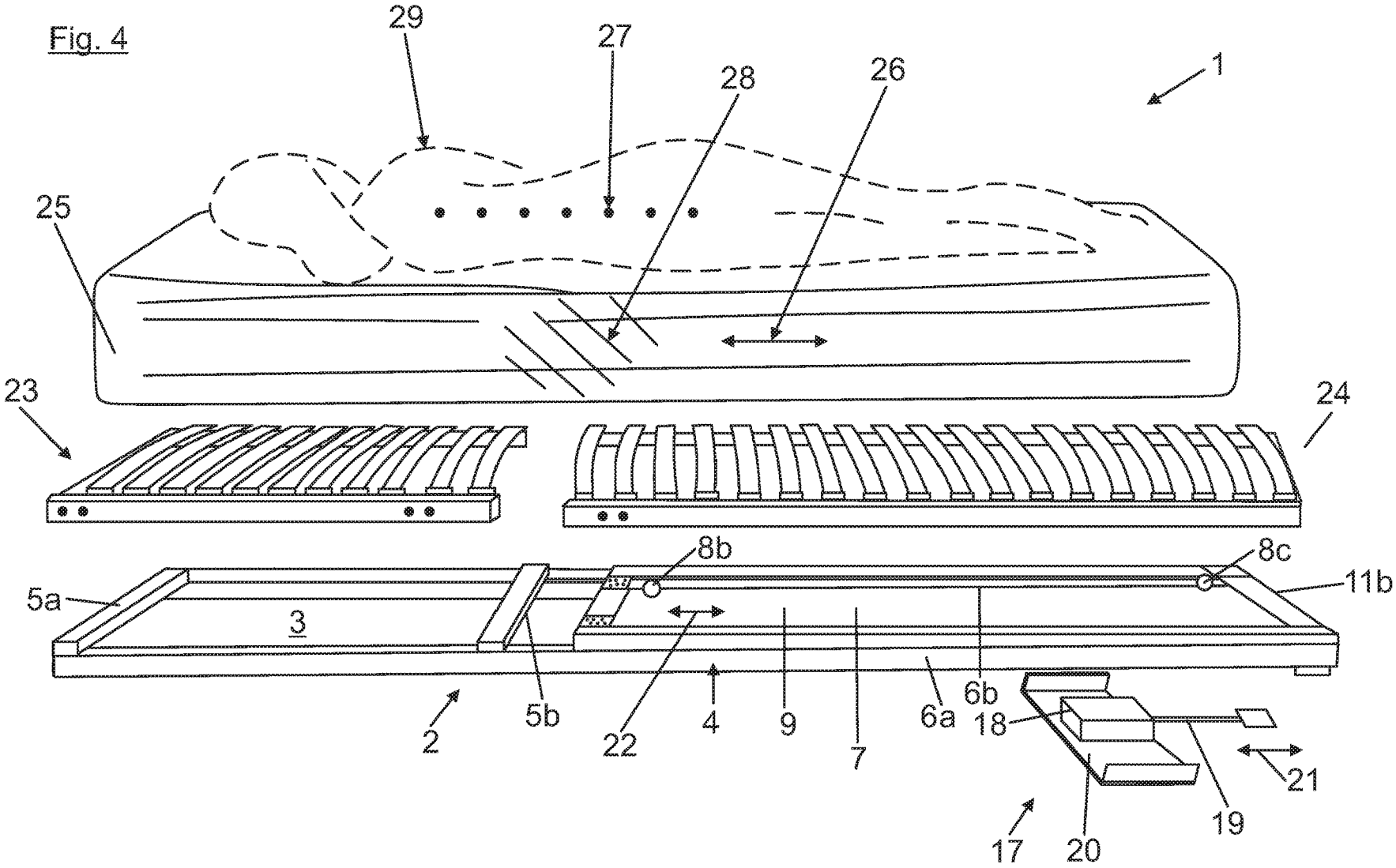
FIG. 4 An exploded view of a fully equipped bed.

FIG. 4 shows an exploded view, in which parts of a complete bed 1 are arranged on top of each other:

At the bottom is shown the fixed frame 2 with its base frame 4, on which the cross struts 5*a*, 5*b* form the upper bed part area 3, which serves as a stationary area for the head and upper body of a person 29.

In the lower frame area 7, the moving frame 9 is already mounted on the rollers 8*a* to 8*d*, which may be moved longitudinally.

For the longitudinal movement of the moving frame 9, a motor drive 17 is shown (not yet mounted), consisting of an electromotive eccentric drive 18 or spindle motor with spindle nut and a push-pull rod 19 serving as a connecting rod or spindle. The eccentric or spindle drive 18 is arranged on a transverse bridge part 20 which is connected to the longitudinal frame parts 6*a*, 6*b* of the fixed frame 2. In its assembled state, the push-pull rod pointing in the longitudinal direction, or the spindle 19 or spindle nut, is connected endwise with the rear cross strut 11*a* of the moving frame 9. In this way, the back and forth movements (arrow 21) of the connecting rod or spindle nut 19 are transferred to the moving frame 9 (arrow 22).

When the bed 1 is complete, a first slatted frame 23 is placed on the upper fixed bed part 3 and a second slatted frame 24 is placed on the moving frame 9, the first upper slatted frame 23 being shorter than the second lower slatted frame 24, and both being spaced from one another by the maximum movement amplitude of the moving frame 9. As a general matter, simple plates or board supports may also be used as underlays for the mattress 25, which is situated on top as the final layer, rather than the slatted frames 23, 24.

In this case, the movement and forces of the moving frame 9 are transferred via the lower slatted frame 24 to the lower area of the mattress 25 (arrow 26) and thus to the buttocks and legs as well as the musculature 27 of a recumbent person 29 (here depicted schematically using dashed lines). In order to favor this a relative movement between the upper fixed mattress area and the lower longitudinally movable mattress area, with only slight counterforces, the mattress 25, as schematically depicted here, may have a compressible and extensible area 28 with slight counterforces, located at the transition between the upper mattress area and the lower mattress area.

Figure 5:
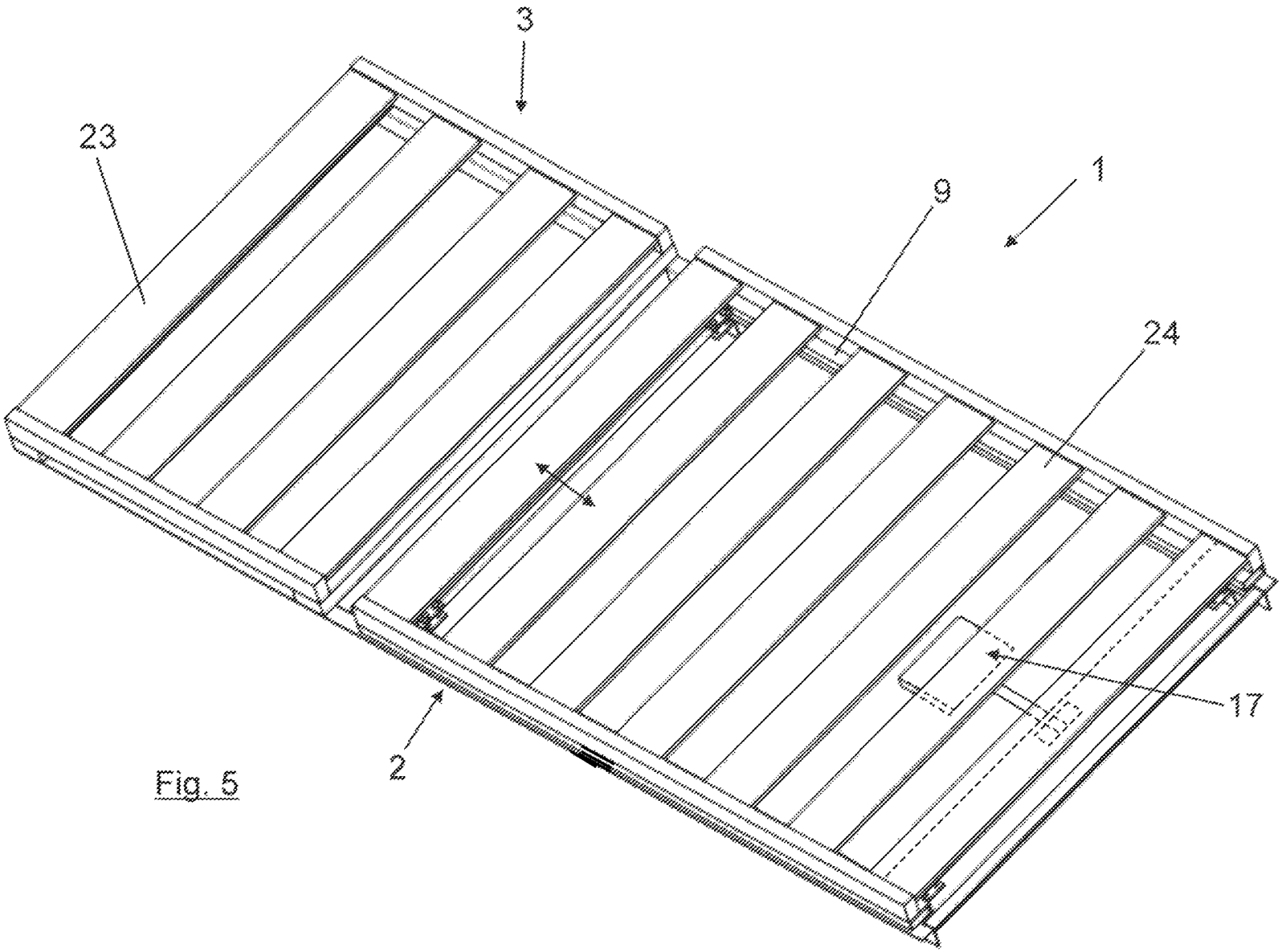
FIG. 5 An illustration of a complete bed substructure with slatted frames.

FIG. 5 shows an example of an assembled bed 1 without a mattress, having a fixed frame 2, a moving frame 9, a slatted frame 23 mounted in the fixed upper resting area 3 and a slatted frame 24 mounted on the moving frame 9, as well as an assembled motor drive 17. Such an embodiment may, for example, be a tradable retail unit which is then available for separate installation or as a replacement for a conventional simple slatted frame to be placed in a bed frame with the addition of a mattress that may be selected subjectively.

LIST OF REFERENCE SIGNS

1 Moving bed
2 Fixed frame
3 Upper bed part
4 Base frame
5*a*, 5*b* Cross strut
6*a*, 6*b* Longitudinal frame parts
7 Lower frame area
8*a*, 8*b*, 8*c*, 8*d* Rollers
9 Moving frame
10*a*, 10*b* Moving frame longitudinal parts
11*a*, 11*b* Moving frame cross struts
12*a*, 12*b*, 12*c*, 12*d* Tracking parts
13 Angle part
14 Angle legs (horizontal)
15 Inclined ramp
16 Angle leg (vertical)
17 Motor drive
18 Electromotive eccentric drive
19 Push-pull rod
20 Bridge part
21 Arrow
22 Arrow
23 First slatted frame
24 Second slatted frame
25 Mattress
26 Arrow
27 Musculature
28 Compressible and extensible area
29 Person

The invention claimed is:

1. A moving bed, comprising:

a stationary longitudinal fixed bed frame extending over an entire bed length, said stationary longitudinal fixed bed frame having opposing longitudinal frame parts and a fixed cross strut, said fixed cross strut having opposite ends respectively fixed on said opposing longitudinal frame parts, said cross strut defining a first frame area being a fixed bed part and delimiting a second frame area adjacent said fixed bed part, said fixed bed part functioning as a resting area for a head and upper body of a person;

a moving frame being supported on top of said stationary longitudinal fixed bed frame in said second frame area, said moving frame disposed in a longitudinally movable manner, said moving frame being shorter than a longitudinal extent of said second frame area; and at least one controllable motor drive mounted and coupled between said stationary longitudinal fixed frame and said moving frame, and said controllable motor drive moving said moving frame alternatingly back and forth relative to said stationary longitudinal fixed frame in a predetermined longitudinal section.

2. The moving bed according to claim 1, wherein said controllable motor drive is disposed on said stationary longitudinal fixed bed frame, said controllable motor drive has a push-pull rod aligned in a longitudinal direction and an electric motor that is coupled to said moving frame by said push-pull rod.

3. The moving bed according to claim 2, wherein said controllable motor drive includes:

said electric motor being an electromotive eccentric drive with said push-pull rod being coupled to said moving frame; or said electric motor having a spindle with a spindle nut being fastened to said moving frame.

4. The moving bed according to claim 2, wherein said controllable motor drive is disposed on said stationary longitudinal fixed bed frame.

5. The moving bed according to claim 1, wherein:

at least one of a frequency of a sinusoidal motion sequence at said controllable motor drive or a motor running time is established by said controllable motor drive.

6. The moving bed according to claim 1, wherein:

said stationary longitudinal fixed bed frame has a rectangular base frame; and said fixed bed part includes a second cross strut attached to said rectangular base frame to define a longitudinal end of said stationary longitudinal fixed bed frame, said cross struts define a length of said fixed bed part, said cross struts have a height that corresponds to a height of said moving frame, so that a substantially flat, continuous bed surface is defined by said fixed bed part and said moving frame.

7. The moving bed according to claim 6, wherein at least one of said stationary fixed frame or said moving frame are produced from metal profiles;

said rectangular base frame has mutually-offset rollers disposed in pairs opposite one another, said rollers are attached to said rectangular base frame of said stationary longitudinal fixed bed frame on said opposite longitudinal frame parts, said mutually-offset rollers are fastened to have roller axes extend transversely; and said moving frame is a rectangular moving frame with longitudinal moving frame parts resting on said mutually-offset rollers for movement of said moving frame.

8. The moving bed according to claim 7, wherein said mutually-offset rollers are positioned toward an inside of said rectangular base frame; and said moving frame has retaining parts disposed on said moving frame to prevent lifting, said retaining parts having tracking parts in which said rollers are guided to ensure lateral tracking.

9. The moving bed according to claim 8, wherein:

said moving frame has moving frame cross struts;

said retaining parts are angle parts that are clamped onto said moving frame cross struts.

10. The moving bed according to claim 6, wherein said cross struts are two spaced-apart cross struts.

11. The moving bed according to claim 7, wherein said mutually-offset rollers are four rollers.

12. The moving bed according to claim 1, further comprising a flat rigid or flexible support mounted respectively on said fixed bed part of said stationary longitudinal fixed bed frame and on said moving frame, said flat rigid or flexible support being spaced in a longitudinal direction.

13. The moving bed according to claim 12, further comprising:

a continuous mattress having a compressible and extensible area, said continuous mattress being disposed on said flat rigid or flexible support.

14. The moving bed according to claim 13, wherein said controllable motor drive is configured to apply a force of at least 50 kp in order to move said moving frame, and the force is transferred to the person via said mattress and said flat rigid or flexible support.

15. The moving bed according to claim 13, wherein said flat rigid or flexible support is a slatted frame.

16. The moving bed according to claim 15, wherein said mattress is disposed on said slatted frame.

17. The moving bed according to claim 1, wherein said fixed cross strut is directly attached to said opposing longitudinal frame parts.

* * * * *